US007575058B2

(12) United States Patent
Franco et al.

(10) Patent No.: US 7,575,058 B2
(45) Date of Patent: Aug. 18, 2009

(54) INCREMENTAL ANNULAR CHOKE

(75) Inventors: Juan P. Franco, Houston, TX (US); Michael A Unger, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 138 days.

(21) Appl. No.: 11/827,035

(22) Filed: Jul. 10, 2007

(65) Prior Publication Data

US 2009/0014185 A1 Jan. 15, 2009

(51) Int. Cl.
*E21B 34/06* (2006.01)
*E21B 43/12* (2006.01)

(52) U.S. Cl. ..... 166/334.4; 166/332.1; 166/334.1; 166/373; 166/386; 138/43; 138/45

(58) Field of Classification Search ..... 166/334.1, 166/334.4, 332.1, 373, 386; 251/206; 137/625.3; 138/43, 45

See application file for complete search history.

(56) References Cited

U.S. PATENT DOCUMENTS

| | | | | |
|---|---|---|---|---|
| 2,900,997 | A * | 8/1959 | Bostock | 137/458 |
| 5,133,407 | A | 7/1992 | Deines et al. | 166/267 |
| 5,332,194 | A | 7/1994 | Austin, Jr. et al. | 251/345 |
| 5,409,601 | A | 4/1995 | Ngo et al. | 210/151 |
| 6,227,302 | B1 | 5/2001 | Pringle et al. | 166/374 |
| 6,276,458 | B1 | 8/2001 | Malone et al. | 166/386 |
| 6,325,153 | B1 | 12/2001 | Harrell | 166/386 |
| 6,543,544 | B2 | 4/2003 | Schultz et al. | 166/373 |
| 6,715,558 | B2 | 4/2004 | Williamson | 166/375 |
| 6,722,439 | B2 | 4/2004 | Garay et al. | 166/373 |
| 6,782,952 | B2 | 8/2004 | Garay et al. | 166/374 |
| 6,860,330 | B2 | 3/2005 | Jackson | 166/332.1 |
| 6,948,561 | B2 | 9/2005 | Myron | 166/240 |
| 6,973,974 | B2 | 12/2005 | McLoughlin et al. | 166/386 |
| 2004/0129423 | A1 | 7/2004 | Eddison | 166/331 |
| 2006/0192160 | A1 | 8/2006 | Cove | 251/62 |
| 2007/0169942 | A1 * | 7/2007 | Loretz et al. | 166/373 |

* cited by examiner

*Primary Examiner*—Giovanna C Wright
(74) *Attorney, Agent, or Firm*—Shawn Hunter

(57) ABSTRACT

An annular choke mechanism is incorporated into a flow path within the outer housing of the sleeve valve to the interior flow ports of the sliding sleeve member. As the sliding sleeve member is moved axially within the housing, the lateral fluid ports of the sliding sleeve member are aligned within particular bore portions so that the size of the annular space between the fluid ports in the housing and the fluid ports in the sleeve is varied. The annular flow area through the annular space governs the rate of fluid flow through the valve.

14 Claims, 5 Drawing Sheets

INCREMENTAL ANNULAR CHOKE

BACKGROUND OF THE INVENTION

1. Field of the Invention

The invention relates generally to sliding sleeve devices which may be used in subterranean wellbores.

2. Description of the Related Art

Sliding sleeve valve devices are well known and widely used in downhole hydrocarbon production. Typically, these devices are made up of an outer tubular housing that defines an axial flowbore within. One or more radial fluid transmission ports are disposed through the outer housing. The outer tubular housing contains an inner sleeve member that is shiftable (typically axially) within the housing. The inner sleeve member also presents a radial fluid port through its body, which is selectively aligned with the fluid transmission port(s) in the housing as the sleeve is shifted within the housing. Typically also, there are annular seal rings located on either axial side of the fluid transmission port(s) to prevent fluid from flowing between the housing and sleeve member.

Problems arise where there is a significant pressure differential between the interior flowbore and the surrounding wellbore. If this situation exists when the sleeve valve is being moved from a closed to an open position, the seal rings are vulnerable to high pressure fluids passing through the aligned fluid ports. The seal rings can be blown out or otherwise damaged during the process of opening the sleeve valve. Damage to the seal rings can seriously degrade or eliminate the ability of the sleeve valve to close off fluid flow into or out of the flowbore.

It is often difficult in practice to prevent this type of damage. Sleeve valves, along with the rest of a production system, are designed to meet expected wellbore conditions. Therefore, if the sleeve valve is expected to have to withstand differential pressures of, for example, 10,000 psi, a valve with seals and other components that can withstand a 10,000 psi differential are used. When actually placed into the wellbore, however, the sleeve valve may experience differential pressures that are much greater than had been anticipated.

Also, there are instances wherein it is desirable to finely control the amount of flow through the valve. This is difficult to do with existing designs. It is also difficult to provide low flow rates with conventional sliding sleeve valve designs. Small-sized ports tend to become easily clogged by debris within wellbore fluid, making the valve essentially inoperable.

U.S. Pat. No. 6,715,558 issued to Williamson describes a control valve with a choke assembly made up of a pair of choke members that are disposed in an end-to-end relation. This device is not a sliding sleeve valve. An axial end of one choke member 110 is formed to provide a flow regulating surface 126. Fluid flows into the axial end of the choke member 110 rather than into a lateral flow port. As the axial distance between the axial ends of the choke members is adjusted, the flow rate into the axial end of the choke member is adjusted.

U.S. Pat. No. 6,973,974 issued to McLoughlin et al. describes a valve assembly to control the intake of fluid. The valve has a valve body and a valve choke. The valve choke has a choke bore and a plurality of orifices to the choke bore spaced at intervals along the valve choke. The valve system is operable to position the valve choke so that a seal disposed between the valve body and the valve choke is located at the intervals between the plurality of orifices.

U.S. Pat. No. 6,722,439 issued to Garay et al. describes a multi-positioned sliding sleeve valve that provides a downhole choke. The sleeve valve includes a hydraulic control system that moves the sliding sleeve a predetermined amount for a given applied control pressure. The choke is a variable orifice.

The present invention addresses the problems of the prior art.

SUMMARY OF THE INVENTION

The invention provides devices and methods for providing an adjustable amount of fluid flow through a sliding sleeve valve. An annular choke mechanism is incorporated into a flow path within the outer housing of the sleeve valve to the interior flow ports of the sliding sleeve member. In a preferred embodiment, the invention features a sliding sleeve valve having an outer housing with an outer radial fluid communication port and an inner sleeve member that is axially moveable within the housing. The sleeve member has an interior radial fluid communication port. An annular space is defined between the outer housing and the sleeve member between the inner and outer radial fluid communication ports. Fluid passing through the valve must pass through this annular space. As the sliding sleeve member is moved axially within the housing, the lateral fluid ports of the sliding sleeve member are aligned within particular bore portions so that the size of the annular space between the fluid ports in the housing and the fluid ports in the sleeve is varied. The annular flow area through the annular space governs the rate of fluid flow through the valve.

In a currently preferred embodiment, the invention provides a tubular insert sleeve that provides an internal surface with annular bore portions having different diameters. However, the valve components may be fashioned in other ways, as well, to provide an annular choke mechanism with variably-sized annular flow areas.

BRIEF DESCRIPTION OF THE DRAWINGS

The invention is best understood with reference to the following drawings, wherein like reference numerals denote like elements, and.

DETAILED DESCRIPTION OF THE PREFERRED EMBODIMENTS

Figure 1:
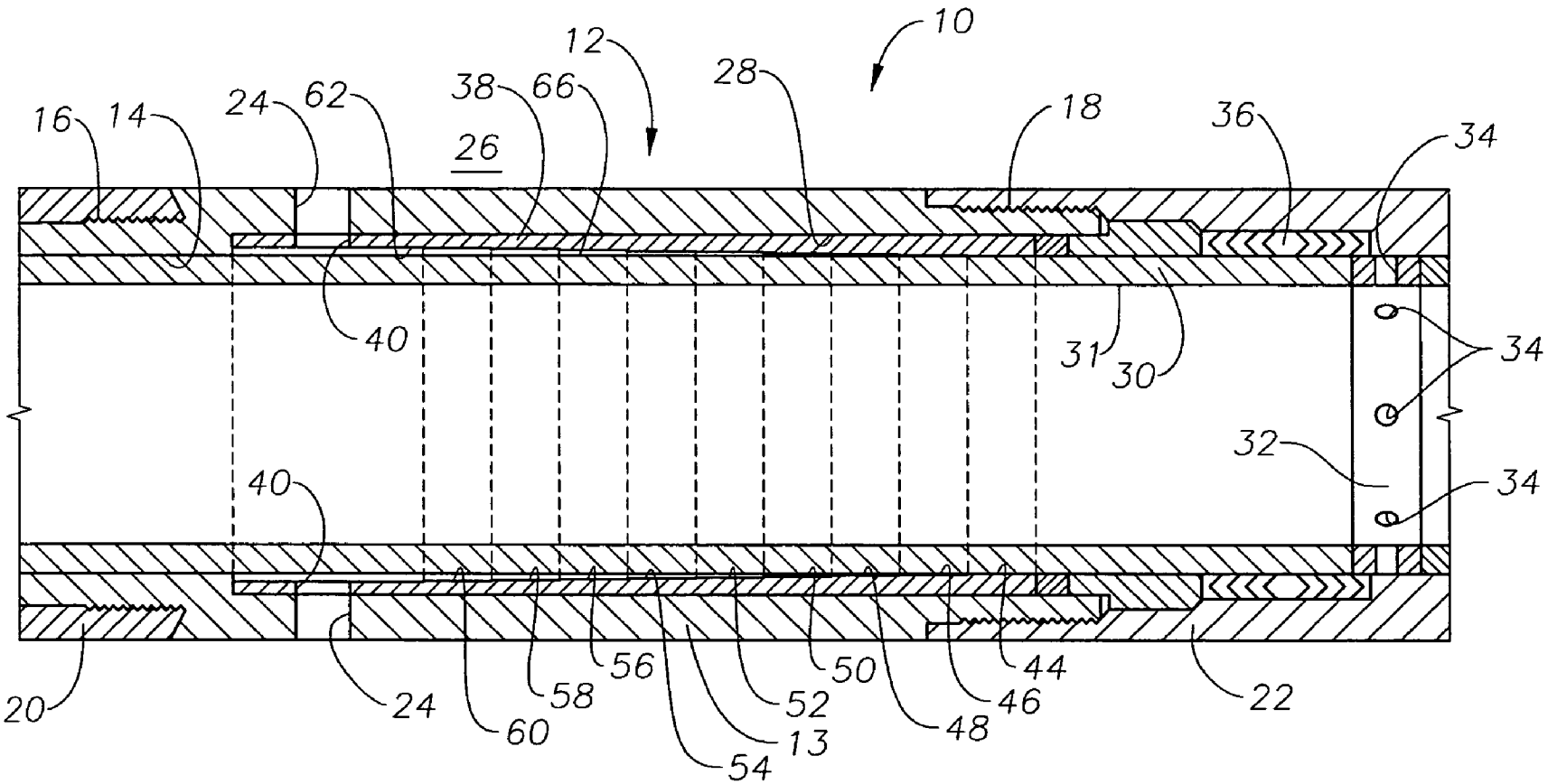
FIG. 1 is a side, cross-sectional view of an exemplary sliding sleeve valve constructed in accordance with the present invention in a fully closed position.

FIG. 1 depicts an exemplary sliding sleeve valve 10 having an outer housing 12 that defines a central flowbore 14 along its length. The housing 12 is made up of an outer sleeve housing sub 13 by threaded connections 16, 18 to adjacent tubular members 20, 22. The sleeve housing sub 13 and tubular members 20, 22 are portions of a complete toolstring, such as a production tubing string of a type well know in the art. Outside lateral fluid transmission ports 24 are disposed through the body of the housing sub 13 to permit fluid to flow between the external annulus 26 and the flowbore 14. An expanded diameter recess 28 is defined into the interior radial surface of the housing sub 13, thereby providing an enlargement in the flowbore 14.

A sliding sleeve member 30 is disposed within the flowbore 14 and is axially moveable therein. The sleeve member 30 defines an axial fluid flow passage 31 and includes a ported section 32 that contains a plurality of fluid transmission ports 34 that are disposed through the body of the ported section 32. It is noted that, where the housing 12 is secured to tubular member 22, an annular seal stack 36, of a type known in the art, is incorporated for forming a positive sliding seal between sleeve member 30 and the housing 12. It is noted that the outer radial surface 66 of the sleeve member 30 is preferably of a substantially uniform diameter.

Figure 2:
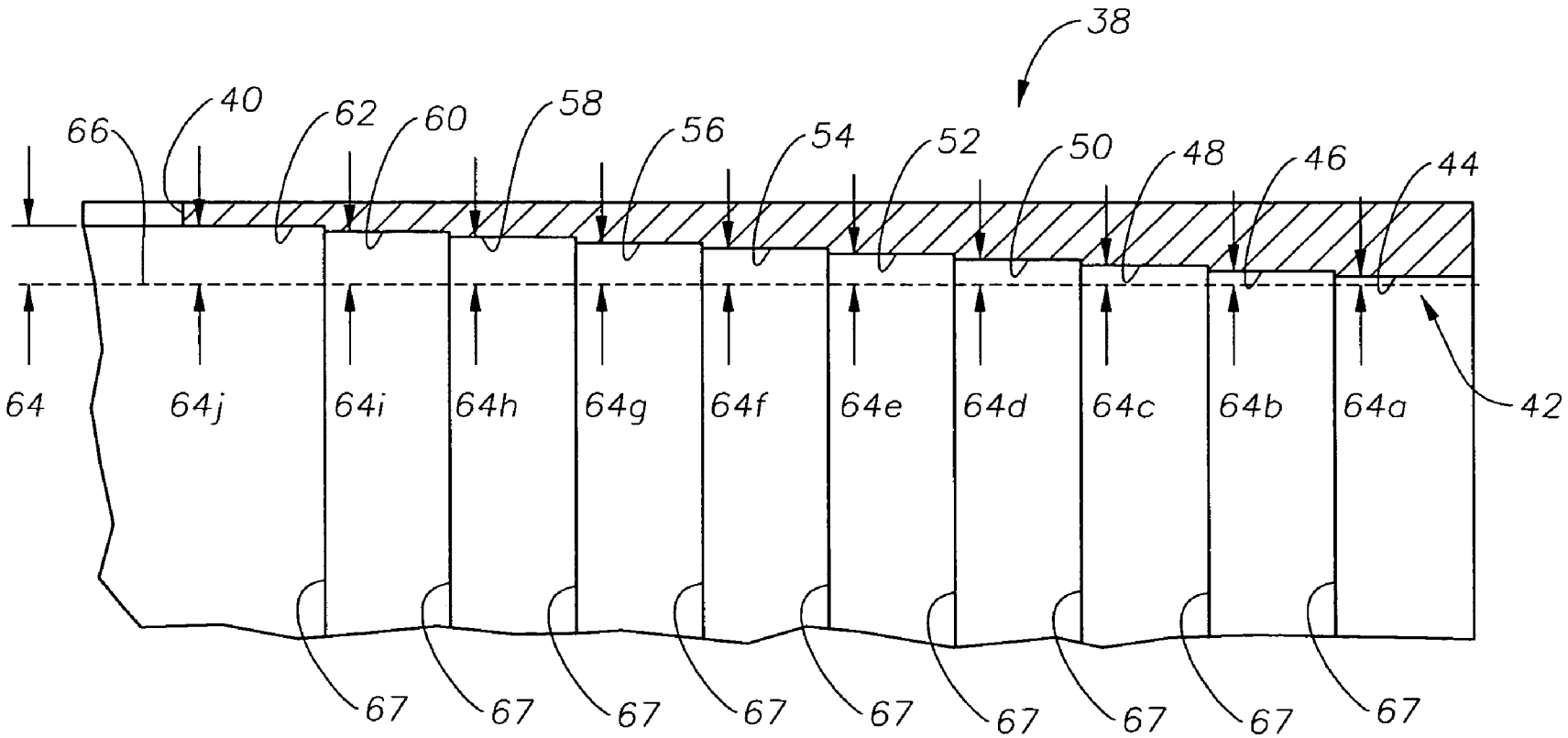
FIG. 2 is a side, cross-sectional view of an exemplary insert used with the sliding sleeve valve shown in FIG. 1, apart from the other components.

An insert 38 is disposed within the expanded diameter recess 28. The insert 38 includes fluid transmission ports 40 that are aligned with the outside fluid ports 24 when the insert 38 is disposed within the recess 28. The structure of the insert 38 is further understood with reference to FIG. 2 wherein the insert 38 can be seen to provide an interior bore surface 42 having a plurality of different diameter bore portions 44, 46, 48, 50, 52, 54, 56, 58, 60, 62. The diametrical dimensions of the interior surface 42 are somewhat exaggerated in FIG. 2 for the purpose of aiding the description. The diameter of each bore portion is progressively larger than the diameter of one of its adjacent bore portions. Thus, as illustrated in FIG. 2, the diameter of bore portion 46 is larger than the diameter of adjacent bore portion 44 before it but smaller than the diameter of adjacent bore portion 48. In one currently preferred embodiment, the diameters of the bore portions are 3.316" for portion 44; 3.320" for portion 46; 3.326" for portion 48; 3.332" for portion 50; 3.340" for portion 52; 3.349 for portion 54; 3.359 for portion 56; 3.370 for portion 58; 3.382" for portion 60; and 3.395" for portion 62. In a sliding sleeve valve system having a sleeve member 30 with a 3.311 inch outer diameter, the various diameters will correspond to the following equivalent port sizes: bore portion 44 (3/16" port); bore portion 46 (1/4" port); bore portion 48 (5/16" port); bore portion 50 (3/8" port); bore portion 52 (7/16" port); bore portion 54 (1/2" port); bore portion 56 (9/16" port), bore portion 58 (5/8" port); bore portion 60 (11/16" port); bore portion 62 (3/4" port). It is noted that the dimensions listed are provided by way of explanation of the underlying principles involved and are not intended to be limiting of the invention. Other sizes, as dictated by the well conditions or end user desires could be used as well. Thus, it can be seen that the various bore portions provide progressively increasing gradations of flow area. Although there are ten different diameter bore portions 44, 46, 48, 50, 52, 54, 56, 58, 60, 62 shown, it will be understood that there may be more or fewer than ten depending upon the needs of the particular sleeve valve system.

An annular flow space 64 is formed between the outer radial surface 66 of the is sliding sleeve member 30 and the housing 12, as illustrated in FIG. 2 wherein the outer radial surface 66 is depicted as a dashed line. As can be appreciated from reference to FIG. 2, the size of the annular space 64 varies with the diameter of the interior bore portions 44, 46, 48, 50, 52, 54, 56, 58, 60, and 62, as indicated by the gaps 64*a*, 64*b*, 64*c*, 64*d*, 64*e*, 64*f*, 64*g*, 64*h*, 64*i*, and 64*j* depicted in FIG. 2. Each of the gaps 64*a*, 64*b*, 64*c* . . . 64*j* is progressively larger than the previous one, with gap 64*j* being the largest and gap 64*a* being the smallest. Each of the gaps 64*a*, 64*b*, 64*c* . . . 64*j* is separated from neighboring gaps by shoulders 67.

A method of operation of the sliding sleeve valve 10 is best understood with reference to FIGS. 1 and 3-5. In FIG. 1, the sleeve valve 10 is in a closed position since the fluid ports 34 of the inner sliding sleeve member 30 are located on the opposite side of the seal stacks 36 which completely prevent fluid flowing in from the annulus 26 through the ports 24 and 40 and axially along the annular space 64 from reaching the interior fluid ports 34 of the sliding sleeve member 30. Fluid from within the flow passage 31 of the sleeve member 30 will also be blocked by the seal stack 36 from flowing radially outwardly through the ports 24, 40 to the annulus 26.

Figure 3:
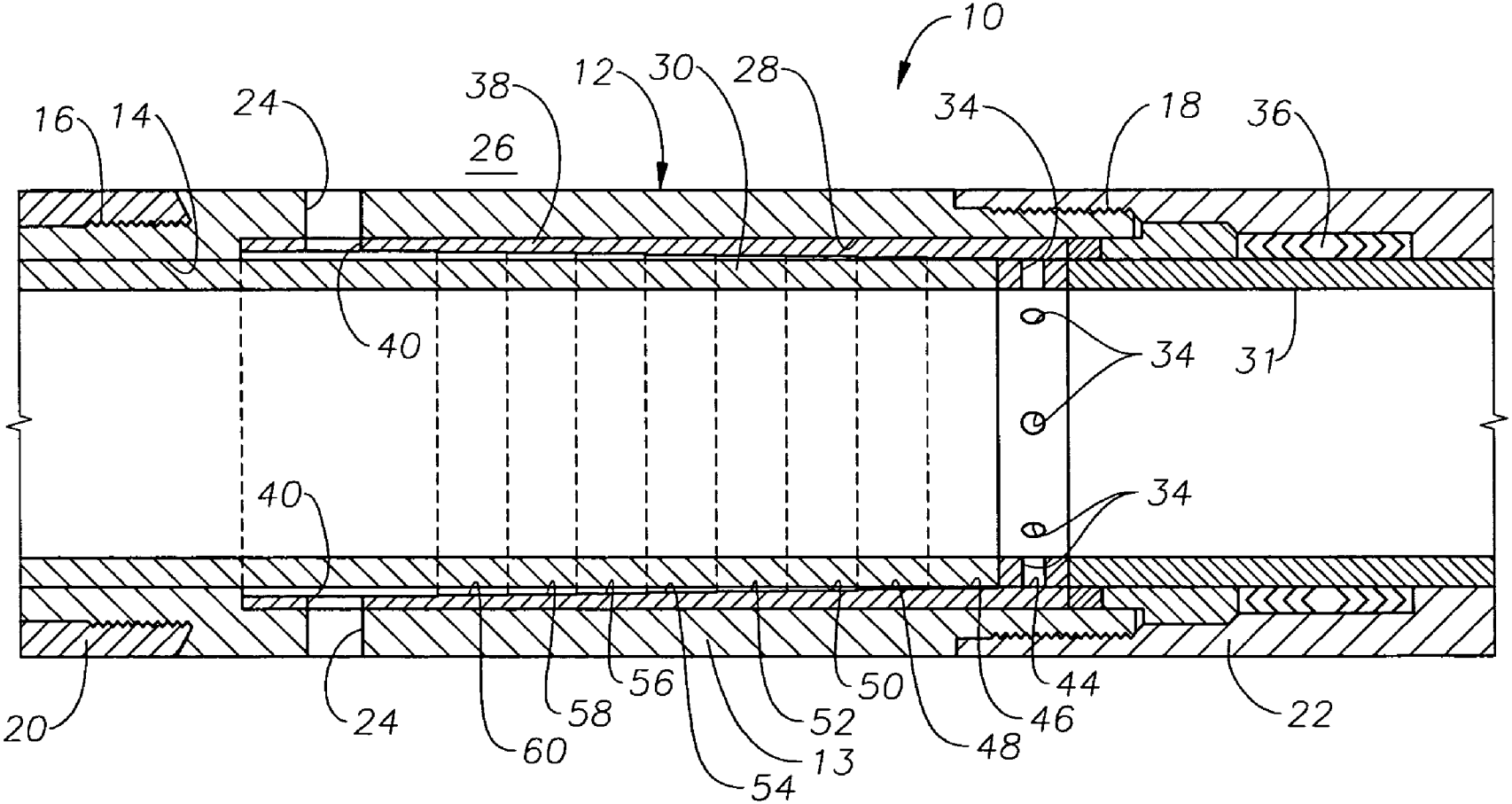
FIG. 3 is a side, cross-sectional view of the sleeve valve shown in FIG. 1 now in a partially opened position.

In FIG. 3, the sleeve member 30 has been moved axially with respect to the housing 12 so that the interior ports 34 are located radially within bore portion 44. In this position, the sleeve valve 10 is open in the most restrictive flow position allowing fluid flow between the annulus 26 and the flow passage 31 and flowbore 14. In order for fluid to enter (or exit) the interior flow ports 34 of the sleeve member 30, the fluid must pass through the smallest annular gap 64*a* of the annular space 64.

Figure 4:
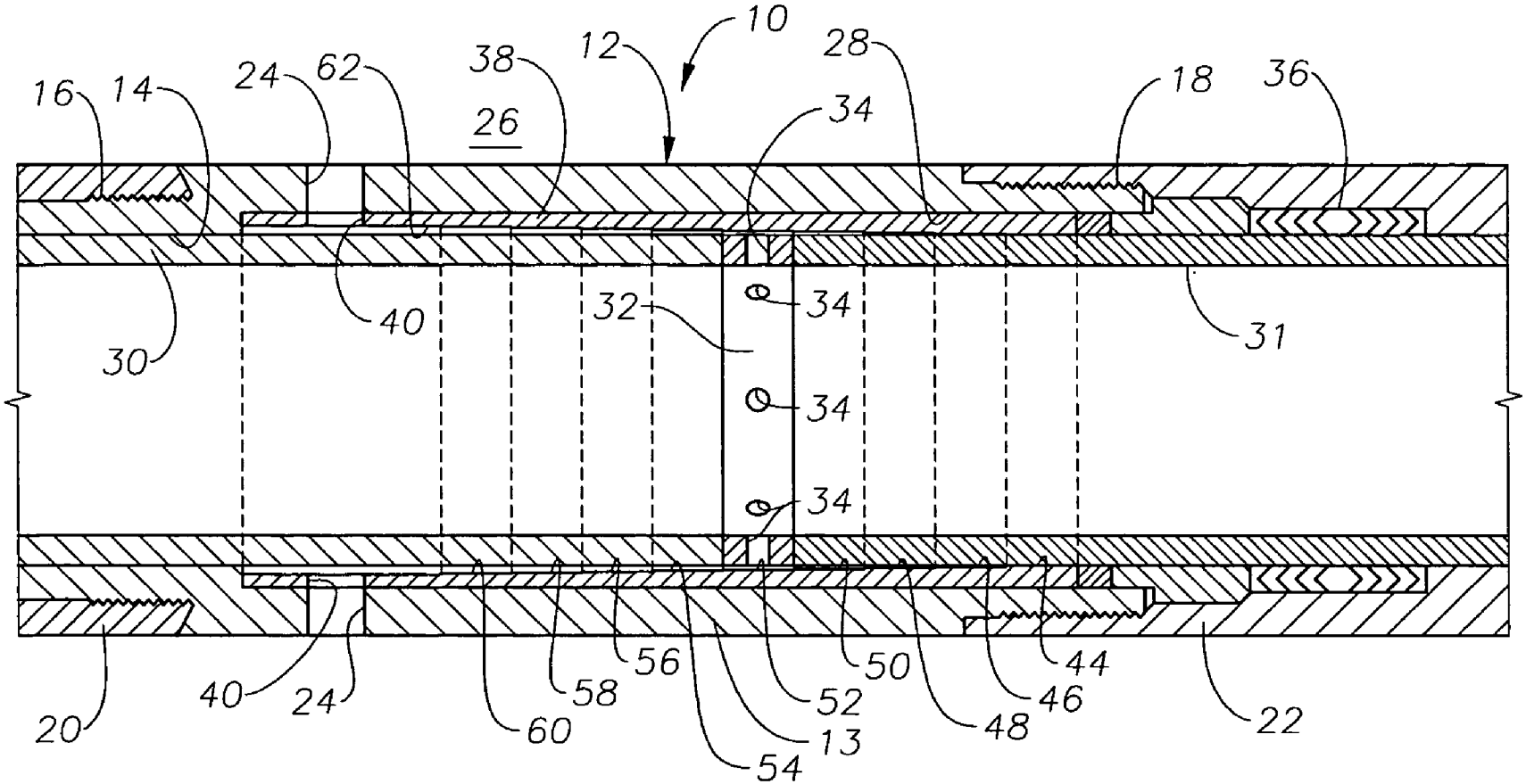
FIG. 4 is a side, cross-sectional view of the sleeve valve shown in FIG. 1 now in a further partially opened position.

In FIG. 4, the sleeve member 30 has been moved axially to an intermediate open position wherein the interior flow ports 34 are aligned with bore portion 52. In this position, the sleeve valve 10 is also partially open, but will permit a greater flow rate between the annulus 26 and the flowbore/flow passage 14, 31 than when the sleeve 30 is in the position shown in FIG. 3. In order to enter (or exit) the interior ports 34 of the sleeve member 30, the fluid must pass through the annular gap 64*e*, which has a larger area than the gap 64*a*, thereby permitting a greater fluid flow rate.

Figure 5:
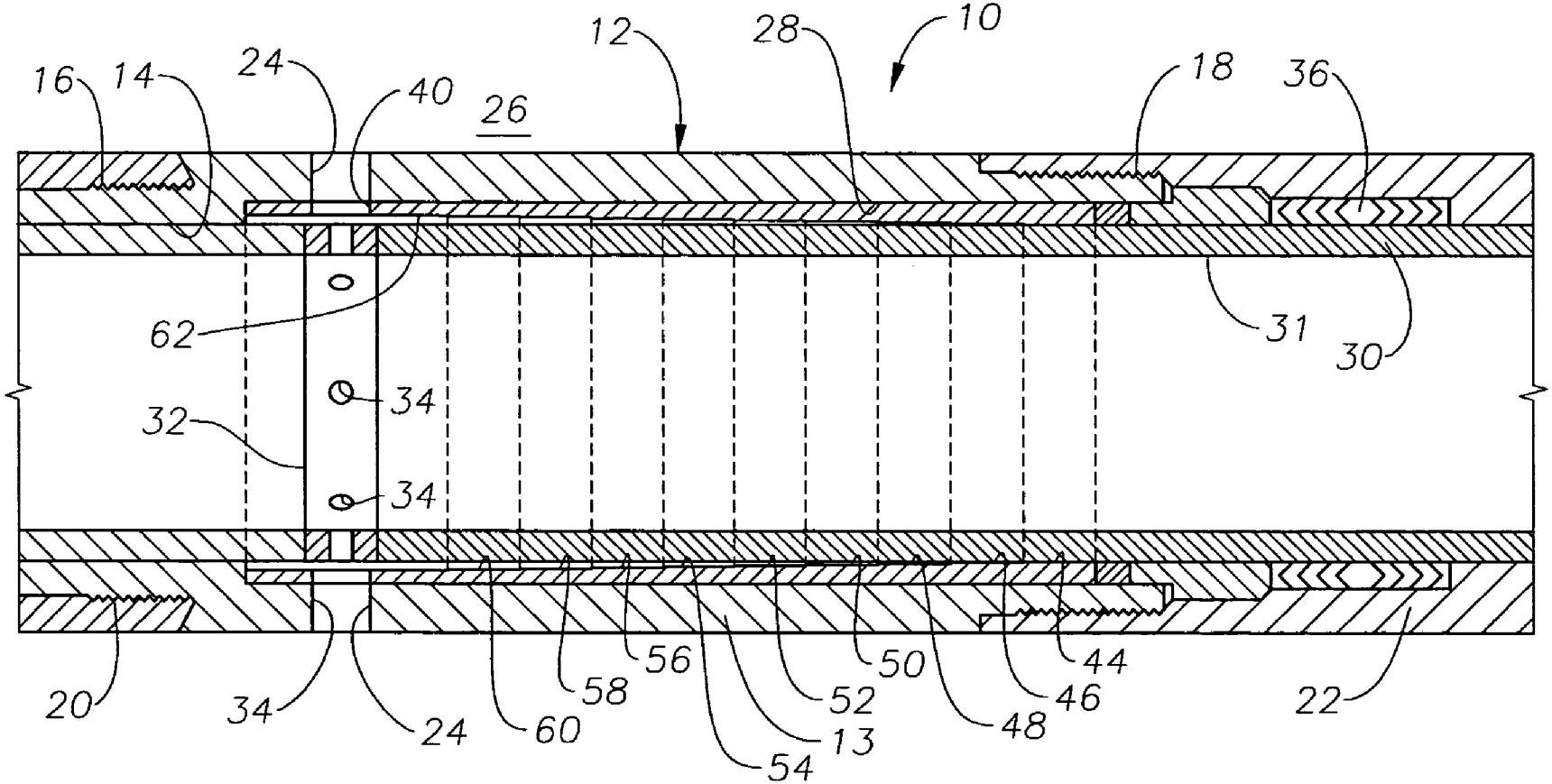
FIG. 5 is a side, cross-sectional view of the sleeve valve shown in FIG. 1 now in a fully opened position.

In FIG. 5, the sleeve member 30 has been moved axially to a fully open position wherein the interior flow ports 34 of the sleeve member 30 are aligned with the bore portion 62. In this position, the interior ports 34 of the sleeve member 30 are positioned immediately adjacent to the exterior fluid flow ports 24 and 40, thereby permitting direct and maximum flow between the external annulus 26 and the interior flowbore/flow passage 14, 31. It is noted that the interior flow ports 34 are sized large enough to permit free fluid flow at the maximum desired rate when not restricted by the area of the annular gap 64. The limitation on flow rate should be imposed by the size of the annular gap 64 rather than the size of the ports 34, 24 or 40.

The sleeve 30 is moved axially with respect to the housing 12 by a stepped, metering valve (not shown) or in other ways known in the art. Actuation of the sleeve 30 may be by hydraulic or mechanical shifting tools as well.

Those of skill in the art will appreciate that the insert 38, sleeve member 30 and annular gaps 64*a*, 64*b*, 64*c*, 64*d*, 64*e*, 64*f*, 64*g*, 64*h*, 64*i*, and 64*j* make up an annular choke mechanism that allows an adjustable amount of fluid flow through the sliding sleeve valve 10. It is further noted that the use of an insert, such as insert 38, is not required. The various-sized bore gaps 64*a*, 64*b*, 64*c*, 64*d*, 64*e*, 64*f*, 64*g*, 64*h*, 64*i*, and 64*j* may be formed by machined surfaces on the inner diametrical surface of the housing 12 of the outer radial surface 66 of the sleeve member 30.

In addition, it can be seen that the sliding sleeve valve 10 permits a method of adjustably flowing fluid through a sliding sleeve valve wherein fluid is flowed from a first radial fluid communication port toward a second radial fluid communication port through an annular flow space defined between the housing and the sleeve member and wherein the flow rate from the first fluid port to the second fluid port is controlled by adjusting the flow area within the annular flow space.

Those of skill in the art will recognize that numerous modifications and changes may be made to the exemplary designs and embodiments described herein and that the invention is limited only by the claims that follow and any equivalents thereof.

What is claimed is:

1. A sliding sleeve valve for selectively transmitting fluid between a flowbore defined within the sleeve valve and an annulus radially surrounding the sleeve valve, the valve comprising:

an outer housing having a housing body defining an axial flowbore therethrough, the outer housing also having an outer radial fluid communication port disposed through the housing body;

a sliding sleeve member moveably disposed within the flowbore, the sleeve member having a sleeve body and defining an axial flow passage therethrough, the sliding sleeve member also having an inner radial fluid communication port disposed through the sleeve body; and an annular flow space defined radially between the sliding sleeve member and the outer housing to govern the flow of fluid through the valve, the annular flow space having a plurality of bore portions which are selected to provide different flow rates between the inner and outer radial ports.

2. The sliding sleeve valve of claim 1 wherein each of the plurality of bore portions presents a different flow area.

3. The sliding sleeve valve of claim 1 wherein:

the sleeve body presents an outer radial surface having a substantially uniform diameter within the annular flow space; and a bore portion from the plurality of bore portions is selected by axially moving the sleeve member with respect to the outer housing to align the inner fluid communication port within a selected bore portion.

4. The sliding sleeve valve of claim 3 wherein the plurality of bore portions provide progressively increasing gradations of flow area.

5. The sliding sleeve valve of claim 1 wherein the bore portions are separated from neighboring bore portions by shoulders.

6. The sliding sleeve valve of claim 1 wherein the plurality of bore portions are provided by a radially inwardly-facing surface having annular surface portions of different diameters.

7. The sliding sleeve valve of claim 6 wherein the annular surface portions of different diameters are fashioned upon the interior radial surface of an insert disposed within the flowbore of the housing.

8. A sliding sleeve valve for selectively transmitting fluid between a flowbore defined within the sleeve valve and an annulus radially surrounding the sleeve valve, the valve comprising:

a generally cylindrical outer housing having an outer radial fluid communication port;

a generally cylindrical sliding sleeve member disposed radially within the outer housing, the sliding sleeve member having an inner radial fluid communication port;

an annular flow space defined between the housing and the sleeve member and extending between the outer and inner radial fluid communication ports, the annular flow space having a plurality of bore portions which are selected to provide different flow rates through the valve.

9. The sliding sleeve valve of claim 8 wherein:

the sleeve body presents an outer radial surface having a substantially uniform diameter within the annular flow space; and a bore portion from the plurality of bore portions is selected by axially moving the sleeve member with respect to the outer housing to align the inner radial fluid communication port within a selected bore portion.

10. The sliding sleeve valve of claim 9 wherein the plurality of bore portions provide progressively increasing gradations of flow area.

11. The sliding sleeve valve of claim 8 wherein the bore portions are separated from neighboring bore portions by shoulders.

12. The sliding sleeve valve of claim 8 wherein the plurality of bore portions are provided by a radially inwardly-facing surface having annular surface portions of different diameters.

13. The sliding sleeve valve of claim 12 wherein the annular surface portions of different diameters are fashioned upon the interior radial surface of an insert disposed within the flowbore of the housing.

14. A method for adjustably flowing fluid through a sliding sleeve valve having an outer housing having a housing body and a first fluid communication port disposed therethrough, a sliding sleeve member moveably disposed within the housing, the sleeve member having a sleeve member body with a second fluid communication port disposed therethrough, the method comprising the steps of:

flowing fluid from the first fluid communication port toward the second fluid communication port through an annular flow space defined between the housing and the sleeve member, the annular space including a plurality of bore portions having different flow areas and wherein the flow area of the annular flow space is chanced by axially moving the sleeve member so that the second fluid communication port is located within a particular bore portion;

changing the flow area provided by the annular flow space to adjust the flow rate of fluid through the sliding sleeve valve.

* * * * *